United States Patent [19]

Croce

[11] Patent Number: 4,781,294

[45] Date of Patent: Nov. 1, 1988

[54] TEAR ORIENTED PACKAGE

[75] Inventor: Carlo P. Croce, Leonia, N.J.

[73] Assignee: Warner-Lambert Company, Morris Plains, N.J.

[21] Appl. No.: 136,252

[22] Filed: Dec. 18, 1987

Related U.S. Application Data

[62] Division of Ser. No. 916,687, Oct. 8, 1986, Pat. No. 4,762,230.

[51] Int. Cl.[4] ..... B65D 85/56; B65D 75/62; B65D 75/68

[52] U.S. Cl. ..... 206/469; 206/604; 206/605

[58] Field of Search ..... 206/484, 484.1, 469, 206/470, 604, 605, 609, 610, 628, 634, 616

[56] References Cited

U.S. PATENT DOCUMENTS

| | | | |
|---|---|---|---|
| 2,839,183 | 6/1958 | LaRosa | 206/628 |
| 3,036,700 | 5/1962 | Krug | 206/365 |
| 3,098,608 | 7/1963 | Anderson et al. | 206/605 |
| 3,175,752 | 3/1965 | Stabenow | 206/605 |
| 3,302,856 | 2/1967 | Thompson et al. | 206/604 |
| 3,355,089 | 11/1967 | Champlin | 206/628 |
| 3,529,718 | 9/1970 | Zaremski | 206/469 |
| 3,540,579 | 11/1970 | Hellstrom . | |
| 3,608,815 | 9/1971 | Bunch | 206/604 |
| 3,625,351 | 12/1971 | Eisenberg | 206/604 |
| 3,980,224 | 9/1976 | Yasuda | 206/604 |
| 4,154,342 | 5/1979 | Wallace | 206/439 |
| 4,203,520 | 5/1980 | Schuster | 206/439 |
| 4,206,844 | 1/1980 | Thukamoto | 206/439 |
| 4,266,667 | 5/1981 | Ishigaki | 206/469 |

FOREIGN PATENT DOCUMENTS

| | | | |
|---|---|---|---|
| 0136996 | 10/1979 | Japan | 206/604 |

*Primary Examiner*—Jimmy G. Foster
*Attorney, Agent, or Firm*—Gary M. Nath

[57] ABSTRACT

A tear oriented package is provided and is formed of a pair of wall members sealed together about their peripheral edges when aligned with one another. In this manner a sealed chamber is formed therebetween for holding preselected items therein. At least one of the wall members is formed of foamed polypropylene material to facilitate the tearing of the one wall member to open the package in one predetermined direction while resisting the opening of the package in other directions due to the orientation of the foamed polypropylene material. The package can be made to be reclosable by placing a predetermined amount of cohesive material on a preselected portion of the package.

12 Claims, 2 Drawing Sheets

TEAR ORIENTED PACKAGE

This is a division of application Ser. No. 916,687, filed on Oct. 8, 1986, now U.S. Pat. No. 4,762,230.

BACKGROUND OF THE INVENTION

Many kinds of consumer products are packaged in flexible pouches including dispensable plastic bags and blister packs of commonly known types. This is true for items such as confectionery and snack products and also for various types of medicinal aids and drugs conventionally marketed over the counter.

For example, for candy, a flexible package is used with crimped end seals and a longitudinal fin seal. This type of package is advantageous in that it can be made virtually airtight and moisture-tight due to the nature and configuration of the seals.

In connection with the blister type package, a flexible lid is applied to the blister package and is sealed around its peripheral edges to enclose the objects within the cavity of an expanded blister. The more rigid puncture resistant and collapse resistant blister aids in the protection of the items packaged therein.

The difficulties with both of these types of packaging concepts is that they are difficult to open to gain access to the items contained therein and they are also incapable, or at least difficult, to reclose when the package has been partially emptied.

In order to maintain the advantages of the flexible and blister type of packages for the consumer market, various types of materials and structures have been developed over the years.

For example, Australian Pat. No. 152,213 is an early example of a flexible sheet of wrapping paper with a moisture-proof outer surface and a cohesive under surface. In this instance, the wrapping material is paper with a waxed outer surface and a latex coating on the inner surface. U.S. Pat. No. 2,432,075 shows a similar concept with the paper containing a cellophane-like outer surface and a latex coated inner surface.

The concept of the use of a material for packaging purposes formed of a polymer film and having linear tear properties is present in U.S. Pat. No. Re. 30,726.

U.S. Pat. No. 4,516,675 extends the wrapping sheet concept to a multi-layer arrangement of plastics and chemicals for purposes of providing a tamper-proof package. The consideration of providing a child-proof or tamper-proof mechanism as part of the packaging structure has further complicated the packaging design field. Accordingly, in addition to giving consideration for ease of opening of the package and the ability to reclose the package, on many occasions it is desirable to provide means for permitting easy access, but providing means for making it difficult to tamper with the package and adulterate the contents. Additionally, in many instance it has become desirable to provide child-proof means to the package while still facilitating ease of opening an access to adults.

U.S. Pat. No. 2,105,367 discloses an early means for providing a flexible wrapper which includes a preformed structure to facilitate opening of the package. In this instance, zones of weakening are provided in the form of notches and a tab to pull a portion of the wrapper in a predetermined direction to tear open the package and permit ease of access.

A further extension of this idea appears in U.S. Pat. No. 3,540,579 where a flexible membrane covers one side of a packaged item and a rigid backing material protects and covers the other side. Bending of the backing material projects the packaged item through the membrane side by bursting the membrane in a predetermined manner.

Other opening aids appear in U.S. Pat. Nos. 3,608,815; 3,980,224 and 4,200,200. U.S. Pat. No. 3,608,815 utilizes an oriented film as part of packaging material whereby the material is minutely expanded at a plurality of points so that a pattern is located on a fold in the material which permits and facilitates grasping and tearing for purposes of opening the package.

U.S. Pat. No. 3,980,224 introduces the use of a tab as part of a package lid including a laminated composite of a uniaxially oriented film and a biaxially oriented film whereby pulling of the tab will open the lid in the uniaxially oriented direction.

U.S. Pat. No. 4,200,200 shows the use of a axially oriented film to facilitate opening of a container by finger pressure to provide a straight line slit in the film. Thus, the axially orientation of a film material facilitates ease of opening in one direction.

As indicated by U.S. Pat. No. 4,200,200, the use of various types of materials to facilitate ease of opening of packaging has been extended to other types of packages than merely flexible wrapping materials.

For instance, blister type packaging has become quite common and examples of background developments in this area can be observed in U.S. Pat. Nos. 3,078,986; 3,941,248; 4,196,809; 4,211,326; 4,233,326; 4,280,621; and 4,398,634.

The blister package of U.S. Pat. No. 3,078,986 teaches the use of a polyethylene coversheet adhesively secured to the blister container with a cutaway corner to facilitate grasping and removal of the lid.

U.S. Pat. No. 3,941,248 is directed to a child-proof or tamper-proof structure where zones of weakening are provided to facilitate breaking away of a single compartment from the remaining compartments. A flexible cover foil is applied to a blister pack container.

U.S. Pat. No. 4,196,809 is also directed to a child-resistant package in a blister pack configuration. A multi-layer flexible cover lid is employed with the layers interconnected so that folding of a corner of the package will cause the layers to separate and facilitate opening to gain access of the contents of the blister package.

The blister package of U.S. Pat. No. 4,211,326 includes a multi-layer lid with one of the laminations of the lid being of a partially-oriented polymeric material. The objective is to enhance the moisture barrier properties, clarity and strength in the thermo-formed state.

U.S. Pat. No. 4,233,326 shows a packaging structure for confections which provides means for ease of access to individual items of a group of items packaged together.

U.S. Pat. Nos. 4,280,621 and 4,398,634 are both directed to child-proof blister packs which also include some of the features discussed above. For example, in U.S. Pat. No. 4,280,621 a laminated cover material is positioned over the blister pack with the layers adapted to be separated to facilitate opening of the package. Folded portions provide indicia for locating the separation point for the layers. U.S. Pat. No. 4,398,634 employs the concept of portions of relief in the form of slits or cuts which directs the user to the proper location for opening of the package or removal of individual units therefrom.

The idea of being able to reclose a package has been of concern for many years. For example, U.S. Pat. No. 1,992,152 deals with the difficulty in reclosing a rubber tobacco pouch. The rubber liner is designed to have tacky portions thereof brought in contact with each other to perform a closure step. The tacky portions are located at a predetermined position on the inner surface of the pouch and permit distortion of the pouch to engage the adhering portions and close the pouch.

A similar concept appears in U.S. Pat. No. 3,735,918 where the container is provided with a series of crossing bands of cohesive material coated on the body and flap of the pouch. Folding of the pouch will cause the cohesive bands to contact one another and reseal the container.

A pressure sensitive adhesive is used in the reclosable package of U.S. Pat. No. 3,613,874 for purposes of permitting resealing of the flexible container.

In connection with the above references, there are used many different types of polyolefin films for flexible wrapping materials in the packaging art, either as an individual wrapping material or in a laminated form. It is also been shown how the linear tear properties of an oriented polyolefin film can be used to advantage. For example, an example of the construction of that type of material appears in U.S. Pat. No. 4,098,406.

As opposed to actual packing, foamed stretched uniaxially oriented polyolefin film material with a pressure sensitive adhesive coating on its underside has been used for labels. For example, U.S. Pat. No. 3,854,581 is of interest in this respect.

However, there is still need for improvement in respect to tear oriented packages, in respect to integrity of the package, ease of opening, tamper and child resistance, and recloseability.

SUMMARY OF THE INVENTION

With the above background in mind, it is among the primary objective of the present invention to provide a tear oriented package including a pair of wall members sealed together about their peripheral edges when aligned with one another so as to form a sealed chamber therebetween for holding preselected items therein. At least one of the wall members includes a foamed polyolefin material to facilitate tearing of the one wall member to open the package in a predetermined direction. At the same time, opening of the package in other directions is resisted due to the orientation of the foamed polyolefin material.

While other polyolefin materials have been found to work effectively, it has been particularly advantageous to use foamed polypropylene in forming the packages of the present invention.

In one form, it is advantageous to form both walls of the package of flexible material so as to form a pouch. One wall of the pouch is formed of a ply of foamed polypropylene and the other wall of the pouch formed of a ply of tear resistant polyester film, for example a conventional well-known material sold commercially under the name, Mylar. The shape of the layers is a matter of choice with a rectangular configuration being one common form. The walls are sealed about their peripheral edges so as to form a chamber therebetween for housing the item to be packaged and thus forming a sealed package. Due to the axial molecular or fiber orientation of the foamed polypropylene, the package can be snapped open by bending or folding the package to cause the polypropylene to separate along a central tear line. This provides access to the interior of the package for removing all or part of the contents contained therein.

It is a further objective to provide a package that is usable as a reclosable pouch. A portion of the separated foam polypropylene wall can be peeled away from the rear wall thus exposing a predeposited spot of cohesive material on the inner surface of the remaining wall. The wall material can be folded over to bring the cohesive spot into engagement with the outer surface of the remaining portion of the foamed polypropylene thereby resealing the package and closing the opening therein.

It is also contemplated that should the selected table adhesive or otherwise common commercially available cohesive material be incompatible with the contents of the package, a conventional type of protective removable label can be used to cover the adhesive until use.

A still further objective is to provide another form of the flexible package with suitable die cuts, fold lines or zones of weakening which facilitate opening of the package by initiating tearing along the oriented polypropylene in alignment with the die cut. The zones of weakening or die cuts can be covered with removable pressure sensitive labels that are removable at the time of use for facilitating opening in the package.

Another objective is to provide another form of the flexible package with both wall members formed of foamed polypropylene. However, one of the walls has its orientation directed at right angles with respect to the orientation of the other wall. In this manner, an appropriate side of the package can be chosen for providing the zones of weakening or die cuts to initiate tearing of the polypropylene. The other layer being at right angles in orientation will resist tearing when the die cut side of the package is opened.

Another objective of the present invention is to take advantage of the properties of foamed polyolefin materials in forming a blister pack which is easy to open, tamper-resistant and reclosable. In fact, a blister package can be formed with the foamed polypropylene as at least part of the lidding lamination which includes novel easy opening features. Various pockets can be formed in the blister and can be easily and selectively accessed.

A variety of different lidding laminations are possible, for example, a lamination of Mylar, foamed polypropylene and a heat sealant coating on the inner surface of the polypropylene. In this type of lamination the Mylar can be metalized for an additional barrier and the Mylar provides additional initial tear-resistance for the lamination and some sealing heat stability. The foamed polypropylene with its axial orientation gives the material its tear direction. It is contemplated that relative heat seal strengths can be engineered to provide a guard against undesirable delamination. For example, if the heat seal coating strength is slightly less than the cohesive strength of the foamed polypropylene, delamination failure can be avoided.

Optionally, an additional layer of Mylar can be provided to permit the use of more aggressive sealants. In that form, the foamed polypropylene is laminated between separate layers of Mylar.

For ease of access, suitable zones of weakness can be formed in the lidding such as die cuts, folds, and other types of mechanical relief. Positioning of the zones of weakening will facilitate opening at various points in the lidding area to gain access to separate compartments within the blister while retaining the others in sealed conditions.

Furthermore, weakened zones or break away portions of the blister portion of the package can also be provided to facilitate detachment and removal of individual portions of the lid to access one or more of the compartments of the blister pack.

In all of the embodiments, an addition of the use of a cohesive material applied in suitable locations or spots facilitates reclosing of the package.

Additional layers can be used in the lamination along with the foamed polypropylene material. Foils and Surlyn, a commercially available iononer marketed by E. I. DuPont De Nemours & Company can be employed along with or as a substitute for the Mylar.

In general, in the embodiments of the present invention there is sufficient tear-resistancy in the structure and package opening is achieved only readily due to the axially orientation of the foamed polypropylene. Hence, previously stated, the die cuts or otherwise weakened zones facilitate this opening action and thus the package can only be opened readily beginning at the die cut. Once opening of the package is initiated, the axial orientation of the foamed polypropylene facilitates opening along a straight line over the surface of the package to the desired degree even to the complete circumference. Once again, a pressure sensitive label can cover the die cut to prevent accidental opening or any attempt to open by a child.

Foamed polypropylene as used in the present invention is a flexible material with an outstanding pearlescent appearance along with its unique tearing capability. Most flexible packaging materials have physical characteristics which differ slightly between the machine direction, that is the direction of material formation and the cross direction, that is the direction at right angles to the machine direction. This would be similar to the grain in paper. The degree of difference between the two directions is often referred to as the orientation of the material. In dealing with most materials, the orientation of a flexible material is usually somewhat subtle and generally important only to a packaging engineer. However, foamed polypropylene contains a much greater degree of linear tear orientation than most materials. Its tensile strength in one direction can be at least 15 times greater than in the other direction. Taking advantage of this feature in the packaging art is extremely advantageous. It makes the material virtually untearable in one direction while it opens as easily as a zipper in the other direction. Thus, as shown by the embodiments of the present invention a new area of packaging is developed with foamed polypropylene employed to assist in facilitating opening of a package, guarding against tampering, and providing for reclosure of the package.

With the above description and objectives of the various embodiments of the invention in mind, reference is made to the attached drawings.

DETAILED DESCRIPTION OF THE DRAWINGS

Figure 1:
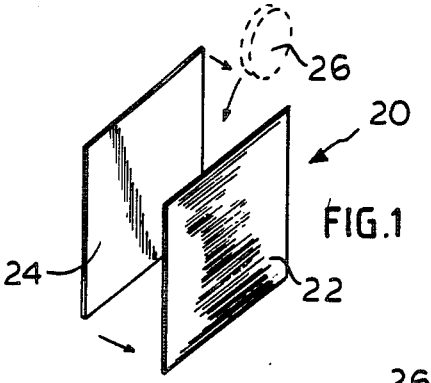
FIG. 1 is a perspective exploded view of a flexible package of the invention with arrows showing the direction of engagement between the wall members and an item to be packaged therein shown in phantom with an arrow showing the direction of insertion.

Package 20 depicted in FIGS. 1–5 is formed of two flexible wall members 22 and 24. The depicted wall members are rectangular in configuration, however, the shape is a matter of choice. The object is to form a sealed pocket for an article to be packaged, for example, a consumer item such as a food product or drug. As shown, a tablet 26 is housed in package 20. Package 20 can be further described as a pouch.

Layer or wall member 22 is formed of a foamed polyolefin material, such as foamed polypropylene. It is flexible and has a high degree of orientation in one direction so that it is easy to tear open along the oriented direction and is resistant to tearing in other directions.

Layer or wall 24 is formed of a tear resistant material such as a flexible Mylar.

Item 26 is inserted between members 22 and 24 and the wall members are then heat sealed around their mating peripheral edges in a conventional manner to form a completely sealed product.

Figure 2:
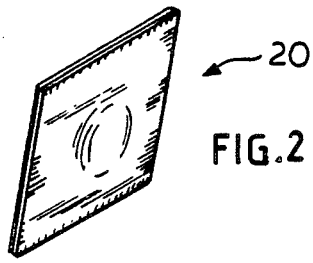
FIG. 2 is a perspective view of a sealed package of the invention.
Figure 3:
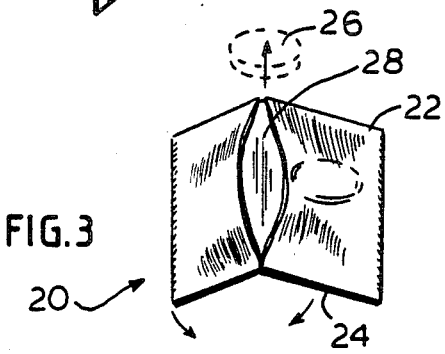
FIG. 3 is a perspective view of the package having been opened with arrows showing the direction of movement during opening and an item in phantom being shown removed from the package.

Sealed package 20 is depicted in FIG. 2. To open the sealed package it need only be folded or snapped in the direction shown in FIG. 3. This will cause the foamed polypropylene 22 to separate or tear along a straight line on its cross section. An opening 28 is produced for access to the interior of the package and removal of article 26 therethrough.

Figure 4:
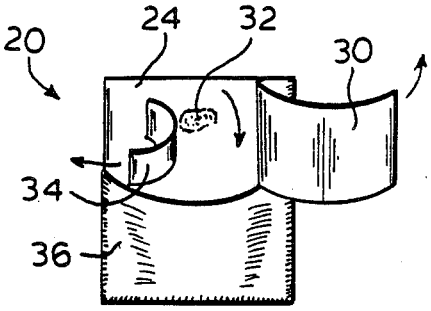
FIG. 4 is a side elevation view of the opened package with arrows showing a portion being removed, a label being removed to expose a spot of cohesive material and the direction of movement of the remaining structure for reclosing of the package.

Thereafter, if reclosing is desired, as shown in FIG. 4, because of the inherent high tensile strength of the foamed polypropylene, one of the remaining portions 30 of the foamed polypropylene layer can be pulled away from the Mylar ply 24. At a predetermined location, a spot of conventional cohesive material such as a normal table adhesive 32 can be prepositioned on the inner surface of Mylar wall member 24.

Figure 5:
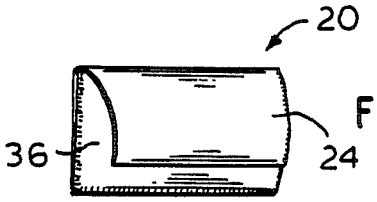
FIG. 5 is a perspective view of the package in reclosed condition.

Should the product be dusty or incompatible with the table adhesive 32 a protective label 34 of a conventional material can be used to cover the adhesive until the package has been opened and it is desired to reclose it. Once the foamed polypropylene portion 30 has been removed, and the protective label 34 has also been removed, Mylar layer 24 can be folded over until cohesive substance 32 engages with the outer surface of the remaining portion 36 of the foamed polypropylene layer 22 to reclose the package 20. This condition is depicted in FIG. 5. This type of package is extremely advantageous where only a portion of the contents of the flexible package are to be removed during a particular use. The package is once again closed since the remaining portion 36 is still sealed about its peripheral edges to the Mylar layer 24 and the remaining portion of the Mylar layer 24 has been folded over to engage with foamed polypropylene portion 36 and to overlie the opening to the package.

The package takes advantage of the unidirectional characteristics of the molecular or fiber orientation of the foamed polypropylene. It will tear very readily in the machine direction while it is very resistant to tearing in the cross direction which is orthogonal to the machine direction. Accordingly, any tear started in the material will propagate only in a straight line along the machine direction of the material. Accordingly, the tear which forms opening 28 depicted in FIG. 3, will travel in a straight line across the width of the package. The location of the tear can be predetermined by strategically placing zones of weakening or tear slits along the foamed polypropylene of the package. The package will open and separate easily and cleanly at each tear slit location leaving a residue package which has the appearance of having been opened by a linear cutting device or by a zipper.

Since the length of the residue package after opening can be precisely controlled in this manner, the opening slit can be positioned to leave a sufficient length of package after product removal to allow for reclosing of the package. This is facilitated by providing the cohesive coating at the appropriate surface for use when the remaining components are folded into overlying position with one another. It is also contemplated that this cohesive coating, in addition to forming the reclosure seal mechanism could also be used to form initial package seals if a total cold seal package is desired. If heat sealed packages are required, the cohesive coating could be applied in a registered pattern over a layer of polyethylene or Surlyn. The polyethylene would provide the initial package seals while the cohesive coating would provide the subsequent reclosure seals. The combination of foamed polypropylene and cohesive coating provides the ability to provide an easily openable resealable package, which improves package integrity and provides increased product protection at the end user level. For particular product package strength and resistance to outside elements such as heat and liquids, appropriate foil materials, Mylar and other well-known commercial materials can be used as a lamination to customize the structure for specific product requirements. The advantage of the tear orientation of the foamed polypropylene still provides the desired advantage.

An example of an acceptable foamed polypropylene material for use in the embodiments of the present invention is marketed by H. P. Smith of Chicago, Ill., a subsidiary of Phillips Petroleum Company and has the following parameters:

Basis Weight—(24×36-500)—40.0#/R
Thickness—5.0 mils
Density—0.512 gms/cc
Yield—10,800 sq. in./lb.
Instron Tensile—CD—900 PSI
Instron Tensile—MD—13,400 PSI
Instron Elongation—CD—5%
Instron Elongation—MD—25%
Elmendorf Tear—MD—16 gms
Smoothness (Sheffield)—25
Opacity—
55%—White
60%—Colored
Stiffness—MD/CD—1.5/0.4 Taber
WVTR—0.30 gms/24 hr./100 sq. in.
Gas transmission, cc/24 hrs./100 sq. in. @1 Atm. differential:
$O_2$ 92
$N_2$ 20
Air 30

Other acceptable foamed polypropylene materials are manufactured and sold and are equally applicable such as the foamed polypropylene material manufactured and sold by Berwick Industries Incorporated of Paramus, N.J.

These type of foamed polypropylenes can also be identified as ribbon-type foamed polypropylenes and have linear tear ratios on the order of 10–15 times difference in tensile strength between the machine and cross directions.

Figure 6:
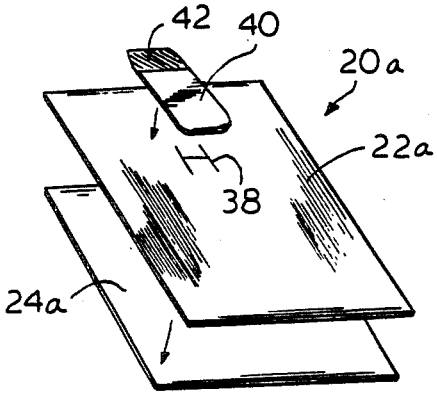
FIG. 6 is a perspective exploded view of an alternative embodiment of a package of the invention with arrows showing the direction of assembly.
Figure 7:
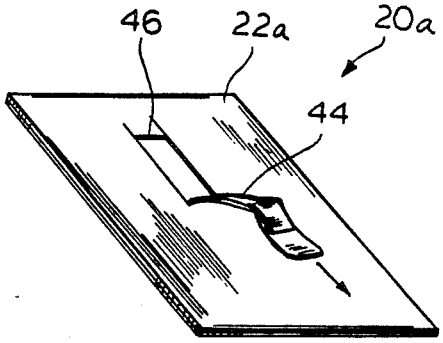
FIG. 7 is a perspective view of the package of FIG. 6 is assembled condition with an arrow showing direction of opening of a portion of the package.

A further embodiment of the invention is depicted in FIGS. 6 and 7. In that form, the flexible package **20*a* is formed as an all flexible pouch with one rectangular layer 22*a* being formed of foamed polypropylene. The other layer 24*a* can also be formed of foamed polypropylene with the orientation arranged at right angles with respect to the orientation of layer 22*a*. Accordingly, when a tear direction is established with respect to layer 22*a*, the layer 24*a* will be tear resistant in that direction. Alternatively, layer 24*a* can be formed of some other tear resistant lamination such as the foamed polypropylene combined with a foil or Mylar material. Layer 24*a* can also be formed of Mylar as layer 24 of the embodiment of FIGS. 1–5**.

To facilitate the opening of package **20*a*, a zone of weakening is formed in the outer surface of foamed polypropylene member 20*a* in a predetermined location. The zone of weakening is shown as a H-shaped die cut 38. The slits or cuts can be of any configuration, for example, X-shaped, or a straight line. A pressure sensitive label 40 with a suitable tab is provided to prevent exposing the die cut 38 until it is desired to open the package. The package is initially formed in the same manner as the embodiment of FIGS. 1–5** in that appropriate sealing means about the periphery of the package seals an item therein. Appropriate conventional hot or cold seals are used for this purpose.

When it is desired to open the package **20*a*, the tab 42 is grasped and the label 40 is pulled off the package. As the label is peeled away, it carries with it a strip of foamed polypropylene 44 of layer 22*a*. This strip will run the length of the package, in effect zipping the package open. The result is an opening 46** to provide access to the interior of the package and removal of the contents therefrom. Because of the tear resistance of foamed polypropylene in the cross direction, the package cannot be readily opened in any other way.

Of course, the label 40 need not be used to assist in opening of the package, in a variation, the pressure sensitive 40 can be applied at right angles to the tear direction of the foamed polypropylene. A less aggressive adhesive can also be used in this form. Thus, removal of the label 40 would not begin the tear but merely access the die cut. The flexible package could then be folded back to permit the gripping of the cut portion of the polypropylene which would act as a zip tab. It is also possible to form this type of package without a weakened zone. The tear nature of the foamed polypropylene layer would permit opening of the pouch by folding the pouch to push the product through the foamed polypropylene which will open along a linear tear line similar to that shown in regard to the embodiment of FIGS. 1–5.

It is also contemplated that a tear string could be inserted between the plies during formation of the pouch or package. An appropriate tear notch for string access can be punched into the foamed polypropylene prior to formation of the package. In this manner, the opening of the pouch is accomplished by pulling the tear string. In those instances where embodiments require accessing of a tear string or a tear notch or a die cut, there is a degree of child-resistant effect with the package.

In another form, the foamed polypropylene can be pleated prior to formation of the package or pouch and the pouch would then be opened only by tearing away the pleat. Similarly, a tear tab can be provided to locate the start of a tear in the foamed polypropylene layer to provide opening of the package. The versatility of the foamed polypropylene layer adds to its advantageous use in the packaging environment for consumer type goods of the type under consideration.

The foamed polypropylene material is also readily usable in blister pack environments. This arrangement is depicted in FIGS. 8–11. In that type of structure, the foamed polypropylene is used as an element of the lidding structure for the blister pack. In the form shown in FIGS. 8–10, the package **20*b* is again formed of two mating wall members or layers. In this instance, there is a flexible lidding layer 22*b* applied in a conventional manner such as by heat or cold seals about the peripheral edges to a blister wall member or layer 24*b*. The blister layer is also formed of a thermo-plastic material but is more rigid in configuration and usually includes a number of formed separate cavities. At least there is one cavity in the blister pack and in the package 20*b* there are eight cavities 48**. They are spaced in rows of four each in longitudinal alignment.

The lidding layer **22*b* is a lamination, the components of which is a matter of choice. It is possible that the entire lid could be formed polypropylene, however more commonly, the lid of FIGS. 8–10 would be utilized. It includes an outer layer of Mylar 50 and an inner layer of foamed polypropylene 52 laminated together in a conventional well-known manner. The surface of the foamed polypropylene 52 which is distal from the Mylar layer has a coating 54 applied thereto for purposes of accomplishing a heat seal with the blister layer 24*b*. In this type of lamination, the Mylar 50 gives the lamination additional tear resistance and some sealing heat stability. If desired, the Mylar can be metalized for providing an additional barrier. The foamed polypropylene 52** gives the material its tear direction. In this configuration it is recommended that the heat seal strength be engineered to be slightly less than the cohesive strength of the polypropylene or polypropylene delamination failure may occur.

Figure 11:
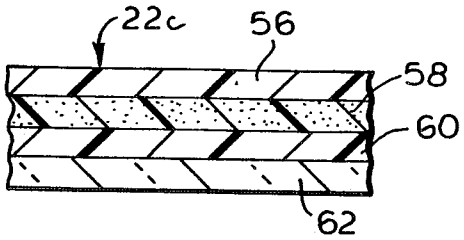
FIG. 11 is a fragmentary sectional view of an alternative lid structure for the package of FIG. 8.
Figure 9:
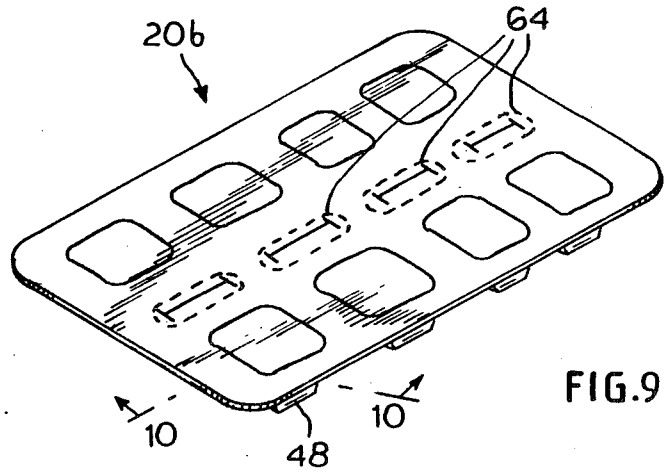
FIG. 9 is a perspective view of the package of FIG. 8.
Figure 8:
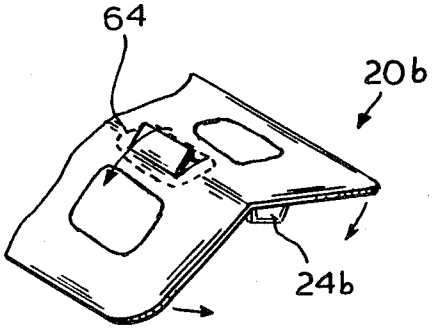
FIG. 8 is a fragmentary perspective view of a further embodiment of the invention with arrows showing the direction of movement during opening thereof.
Figure 10:
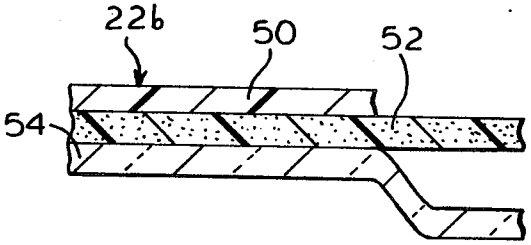
FIG. 10 is a fragmentary sectional view of a portion of the lid of the package of FIG. 8 taken along the plane of line 10—10 of FIG. 9.

If this is not a convenient engineering accommodation, an additional layer of Mylar, as shown in the form of FIG. 11, will allow the use of more aggressive sealants. In the form of FIG. 11, layer **22*c* includes an outer Mylar ply 56, an intermediate foamed polypropylene ply 58 and an inner Mylar ply 60. The heat seal coating 62 is applied to the exposed inner surface of Mylar ply 60. Otherwise operation of lid layer 22*c* is the same as in respect to lid layer 22*b* of FIGS. 8–10**.

The use of the foamed polypropylene as a blister package lidding lamination permits the construction of a blister pack with improved easy opening features. For example, by orientating the lidding stock in a predetermined direction and selectively dropping out the seal area, for example by die cutting or relieving the sealing die, a package is prepared whereby each pocket can be easily and selectively accessed.

For example, die cuts 64 are in the blister material of layer **24*b* and are spaced along the length of package 20*b* at spaced intervals to provide suitable slits in the lidding material. A zone of weakening 64 is provided at predetermined points along the length of the package 20*b*. The relieved materials at the zones of weakening 64 can be grasped and pulled which will peel away a portion of the lid layer 24*b* in the direction determined by the orientation of the foamed polypropylene thus exposing an individual cavity 48 for access to the interior thereof and removal of a suitable item for consumption. The remaining cavities 48** remain in sealed condition until it is necessary to open each individual cavity.

In the depicted form, each cavity can be individually opened. Alternatively, by repositioning the weakened zones, a row of two cavities or row of four cavities can be simultaneously opened with the opening initiated at the weakened point and the foamed polypropylene again determining the tear direction across the surface of the blister pack.

As with the flexible package, the blister pack can be provided with suitable tear tabs with protective cover labels whereby the blister would be unopenable until the cover label or cover strip is removed and the individual tabs pulled.

As stated, a portion of the blister can be cut or scored to facilitate breakaway and once the portion of the blister is snapped off, the oriented foamed polypropylene lidding would determine the direction of opening as the broken away portion of the blister and the attached lidding is pulled open. This type of structure also provides a tamper or child-resistant feature.

As stated above, the flexible wall members or layers of the various structures can be formed of foamed polypropylene or a lamination of the foamed polypropylene with other materials such as Mylar, foils, Surlyn and other commonly-used flexible packaging elements for providing various advantages to the packaging structure. These would include naturally, heat resistance, liquid resistance, and tear resistance.

Thus, the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A tear oriented package for items comprising:

a first wall member of foamed polypropylene material having a tear orientation and a die-cut thereon to facilitate the tearing of said first wall member in a predetermined direction; and a second wall member sealed to said first wall member at their peripheral edges to form a sealed chamber therebetween for holding said items therein.

2. The invention in accordance with claim 1 wherein said first wall member is a lamination formed of a tear resistant polyester film outer layer and a foamed polypropylene inner layer having a heat sealant coating on its exposed inner surface for engagement with said second wall member, said second wall being formed of an expanded plastic material forming a blister, and said first wall member forming a lid for the blister member by heat sealing said first wall member on a preselected surface of said second wall member.

3. The invention in accordance with claim 2 wherein said second wall member contains a series of expanded cavities forming compartments for containing articles to be packaged and said first wall member being provided with a plurality of said die-cuts arranged at predetermined portions on its surface to facilitate engagement with portions of said first wall member to initiate peeling of a portion thereof away from said second wall member with the die-cuts and the orientation of the foamed polypropylene layer determining the portion and direction of removal of the lid from the blister to expose one or more compartments therein for access to the contents thereof.

4. The invention in accordance with claim 2 wherein said first wall member is formed entirely of foamed polypropylene with a heat sealant coating on the interior surface thereof for engagement with said second wall member, and said second wall member being weakened at a predetermined location thereon to form a break away portion to be removed with a portion of the foamed polypropylene member along oriented tear lines thereon to provide access to the interior of the package.

5. The invention in accordance with claim 1 wherein said first wall member comprises a lamination formed of an outer layer of tear resistant polyester film, an intermediate layer of foamed polypropylene, and an inner of tear resistant polyester film, and a heat sealant coating is applied to the exposed surface of the inner layer of polyester film material.

6. A package for holding items which comprises:

a first wall member;

a second wall member of foamed polypropylene material having a tear orientation and sealed to said first wall member at their respectively aligned peripheral edges to form a sealed chamber for holding said items therein, said second wall member being formed with a die-cut separable from said second wall member for tearing said second wall member in the direction of said tear orientation to open said package.

7. A package as recited in claim 6 further comprising a label covering said die-cut and attached thereto for separating said die-cut from said second wall member when said label is lifted from said second wall.

8. A package as recited in claim 7 wherein said first wall is formed with an expanded cavity forming a compartment for holding said items therein.

9. A package as recited in claim 8 wherein said die-cut is H-shaped.

10. A package as recited in claim 9 wherein said first wall member is formed with a plurality of expanded cavities.

11. A package as cited in claim 10 wherein separate die-cuts are each positioned on said second wall member in relation to each expanded cavity to individually open said cavities upon selectively lifting a die-cut to tear said second wall.

12. A tear oriented package for items comprising:

a first wall member of foamed polypropylene material having a tear orientation to facilitate the tearing of said first wall member in a predetermined direction;

a second wall member sealed to said first wall member at their peripheral edges to form a sealed chamber therebetween for holding said items therein, said second wall member being formed of a tear resistant polyester film lamination and a tear string insert between the members during formation of the package and access means formed in the package for exposure of a portion of the string whereby grasping of the exposed portion of the string and pulling thereof will tear the foamed polypropylene member thereby opening the package.

* * * * *